US009232825B2

(12) United States Patent
Bencini

(10) Patent No.: US 9,232,825 B2
(45) Date of Patent: Jan. 12, 2016

(54) WEARABLE PROTECTION DEVICE

(71) Applicant: DAINESE S.P.A., Molvena (IT)

(72) Inventor: Marcello Bencini, Molvena (IT)

(73) Assignee: DAINESE S.P.A., Molvena (IT)

( * ) Notice: Subject to any disclaimer, the term of this patent is extended or adjusted under 35 U.S.C. 154(b) by 0 days.

(21) Appl. No.: 14/403,118

(22) PCT Filed: May 30, 2013

(86) PCT No.: PCT/IB2013/054476
§ 371 (c)(1),
(2) Date: Nov. 21, 2014

(87) PCT Pub. No.: WO2013/182959
PCT Pub. Date: Dec. 12, 2013

(65) Prior Publication Data

US 2015/0164154 A1 Jun. 18, 2015

(30) Foreign Application Priority Data

Jun. 5, 2012 (IT) ..... VR2012A0114

(51) Int. Cl.
*A41D 13/015* (2006.01)
*A41D 13/05* (2006.01)

(52) U.S. Cl.
CPC ..... *A41D 13/015* (2013.01); *A41D 13/0531* (2013.01)

(58) Field of Classification Search
CPC ... A41D 13/015; A41D 1/04; A41D 13/0531; A61F 5/028; A61F 5/3784; A61F 5/0118; A61G 1/01; A41B 13/06
USPC ..... 2/455, 92, 467, 44; 128/870, 873, 874; 602/19, 20
See application file for complete search history.

(56) References Cited

U.S. PATENT DOCUMENTS 4,680,812 A 7/1987 Weigl
4,692,946 A * 9/1987 Jurga ..... 2/22
(Continued)

FOREIGN PATENT DOCUMENTS

DE 102010005939 7/2011

OTHER PUBLICATIONS

PCT International Search Report mailed on Sep. 19, 2013 for PCT Application PCT/IB2013/054476 filed on May 30, 2013 in the name of Dainese S.P.A.
(Continued)

*Primary Examiner* — Tejash Patel
(74) *Attorney, Agent, or Firm* — Steinfl & Bruno LLP

(57) ABSTRACT

A wearable protection device with a plurality of plate members adjacent in a side-by-side configuration so as to define a protection front surface or side adapted to face an impact is described. Pairs of the plate members at least partially overlap each other along a longitudinal direction by means of superposition of a portion of a first plate member on a front surface of a corresponding portion of a second plate member adjacent in the side-by-side configuration, so as to define a zone of surface discontinuity between adjacent plate members on the front surface of the second plate member. The device comprises a plurality of pads each associated with one of the plate members on an opposite side to the protection front surface. A surface discontinuity or boundary zone between adjacent pads is offset along the longitudinal direction with respect to the zone of surface discontinuity between adjacent plate members.

19 Claims, 10 Drawing Sheets

(56) References Cited

U.S. PATENT DOCUMENTS

| | | | | |
|---|---|---|---|---|
| 5,140,995 | A * | 8/1992 | Uhl | 128/846 |
| 5,328,447 | A | 7/1994 | Kapounek et al. | |
| 5,400,801 | A * | 3/1995 | Archer, III | 128/846 |
| 5,768,717 | A * | 6/1998 | Le Sueur | 2/467 |
| 6,852,087 | B1 | 2/2005 | Dainese | |
| 7,188,370 | B2 * | 3/2007 | Bevier | 2/22 |
| 7,329,230 | B2 * | 2/2008 | Mazzarolo | 602/19 |
| 8,082,602 | B2 * | 12/2011 | Crelinsten et al. | 2/455 |
| 8,161,569 | B2 * | 4/2012 | Hudon et al. | 2/22 |

OTHER PUBLICATIONS

PCT Written Opinion mailed on Sep. 19, 2013 for PCT Application PCT/IB2013/054476 filed on May 30, 2013 in the name of Dainese S.P.A.

PCT International Preliminary Report on Patentability completed on Aug. 26, 2014 for PCT Application PCT/IB2013/054476 filed on May 30, 2013 in the name of Dainese S.P.A.

* cited by examiner

WEARABLE PROTECTION DEVICE

CROSS REFERENCE TO RELATED APPLICATIONS

The present application is the US national stage of International Patent Application PCT/IB2013/054476 filed on May 30, 2013 which, in turn, claims priority to Italian Patent Application No. VR2012A000114 filed on Jun. 5, 2012.

The present disclosure relates generally to the clothing sector, for example the sector of sports clothing for sports activities or dynamic activities. More particularly, the present disclosure relates to a protection device, in particular a personal wearable protection device for protecting a user's body against impacts when practising a dynamic sport or similar dynamic activity. For example, said device is used to protect a passenger or rider of a motorcycle, a cyclist, a skier, or a person who is performing a working activity where there is the risk of impacts.

Known wearable protection devices include, for example, back shields for motorcycling use, which comprise a substantially rigid plate worn in close contact with the user's body so as to protect it in the event of an impact.

Also known are back shields including a plurality of rigid plate members which are arranged alongside each other so as to form a protective surface, the plate members being placed on a substantially inextensible support base consisting of soft fabric and acting as a padding.

In particular the present disclosure is based on the recognition by the inventor that the known back shields, while they include a plurality of plate members connected together, do not allow satisfactory "mobility" of the wearable protection device, namely they do not allow the device to adapt to the movements of the body, while ensuring effective protection. These drawbacks exist in particular in back shield devices, but similar drawbacks also exist in known protection devices which are intended for the protection of other parts of the body or body articulations.

According to the present state of the art, therefore, there exists a need to improve the protective characteristics of the wearable devices of the prior art.

The starting point for the present disclosure is the technical problem of providing a wearable device for protecting a user's body from impacts, which device is able to meet the need mentioned above with reference to the prior art and/or achieve further advantages and characteristics.

This is obtained by providing a wearable protection device as defined in the independent claim 1. Secondary characteristic features of the aforementioned protection device are defined in the corresponding dependent claims.

The protection device may be for example a back shield or spine protector, an elbow protector or shoulder protector or a device for protecting other parts of the body. According to one aspect of the present disclosure, the inventor of the present disclosure has recognized that, by using a plurality of pads each associated with a respective plate member and also choosing a given spatial relationship between the pads and the respective plate members, it is possible to obtain satisfactory results in terms of mobility of the protection device and level of protection provided by it.

In particular, the protection device according to the present disclosure includes a plurality of pads, wherein each pad is associated with a corresponding plate protection member. Essentially, one or more underlying pads are provided for each plate protection member. It follows that in the protection device according to the present disclosure a plurality of pads which are physically separate from each in the same way as the plate members are provided, said pads providing the protection device with a high degree of mobility so as to be able to follow the movements of the body portion with which it is associated, while ensuring an adequate degree of protection. For example, in the case of a back shield for a motorcyclist, the back curves on one side when the motorcyclist travels around a bend. Owing to the fact that each plate member and each associated pad are structurally independent and separate from a plate member and respective associated pad, it is possible to obtain lateral curving movements on both sides in a harmonious manner and without creating discomfort for the user. In other words, a back shield according to the present disclosure is able to follow these deformations, since both the plate members and the pads may move away from and towards the adjacent plate members and the adjacent pads respectively.

Moreover, according to one aspect of the present disclosure, in order to ensure effective protection, the plate members partially overlap so that a portion of a first plate member is superposed on the outer side, namely on the protection front surface or side, of an adjacent plate member, so as to define therefore a discontinuity between plate members on said front surface.

The pads are arranged side-by-side so that a discontinuity between two adjacent pads is offset in the longitudinal direction with respect to a discontinuity zone between two adjacent plate members.

It is thus prevented that discontinuities, namely spaces without protection, between the plate members and the pads, coincide with each other.

Consequently, should an impact occur in a zone corresponding to the discontinuity zone between the pads occur, protection would in any case be assured since, in this zone, at least one plate member is present. Similarly, should an impact occur in a zone corresponding to a discontinuity zone between the plate members, protection would in any case be assured by the fact that in this zone there is at least one of the two plate members (for example the second plate member) and an underlying pad.

In one embodiment, overlapping is obtained by means of a portion of the first plate member having, for example, a fin-like or lobe-like form which overlaps a corresponding portion of the second plate member. This portion of the first plate member, when viewed from the side of the protection front surface, has a width smaller than the second plate member which it overlaps. As a result the second plate member laterally surrounds the portion of the first plate member.

Consequently, should an impact occur in a zone of discontinuity between said fin-like portion of the first plate member and the corresponding portion of the second plate member, this impact may be distributed over the whole of the second plate member owing to the fact that the latter surrounds said fin-like portion of the first plate member.

Further advantages, characteristic features and the modes of use of the subject of the present disclosure will become clear from the following detailed description of embodiments thereof, provided solely by way of a non-limiting example.

It is clear, however, that each embodiment of the subject of the present disclosure may have one or more of the advantages listed above; in any case it is not required that each embodiment should have simultaneously all the advantages listed.

Reference shall be made to the figures in the accompanying drawings in which.

Figure 1:
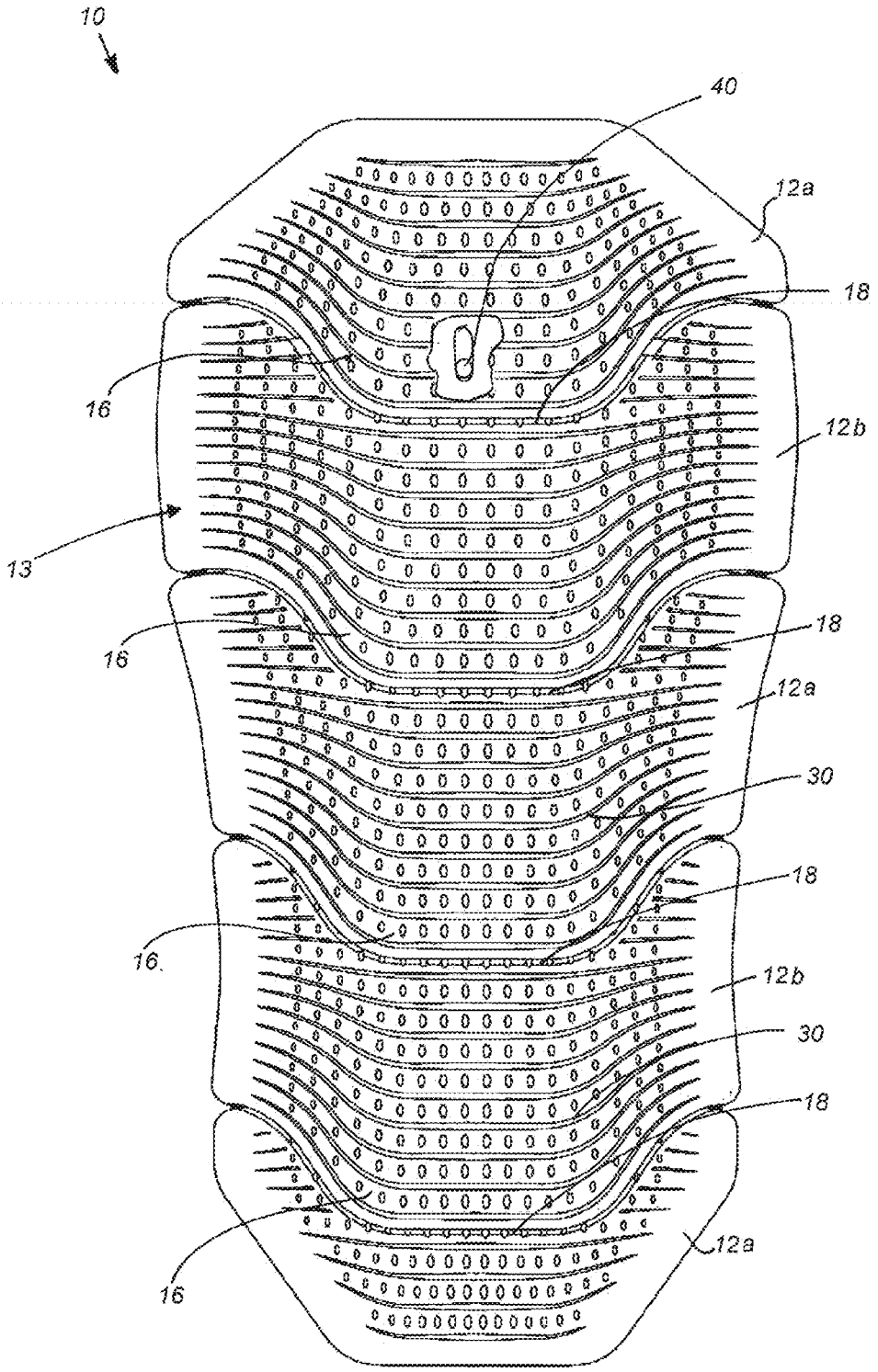
FIG. 1 shows a front view of a wearable protection device according to an embodiment of the present disclosure.
Figure 2:
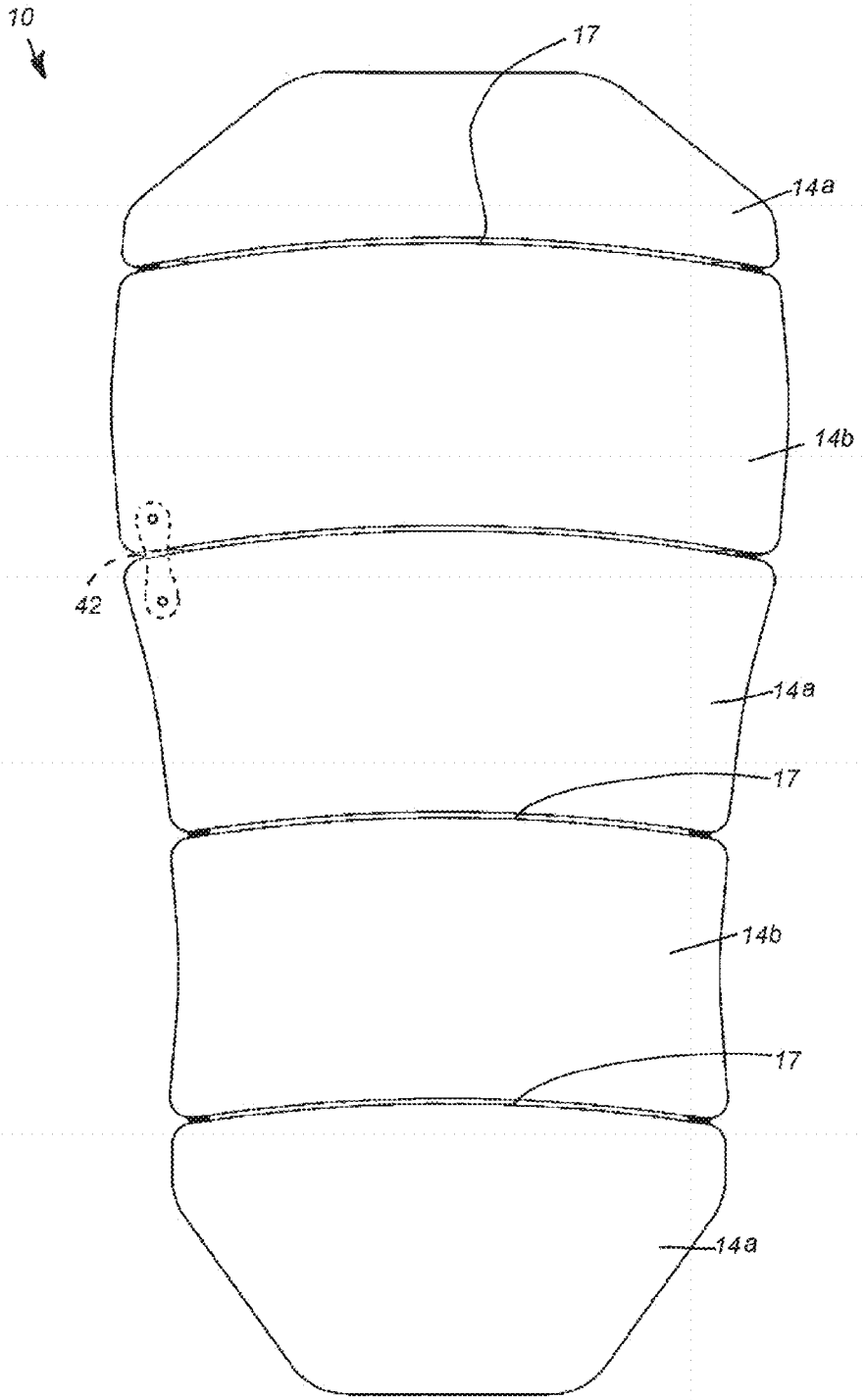
FIG. 2 shows a rear view of a wearable protection device according to an embodiment of the present disclosure.
Figure 4:
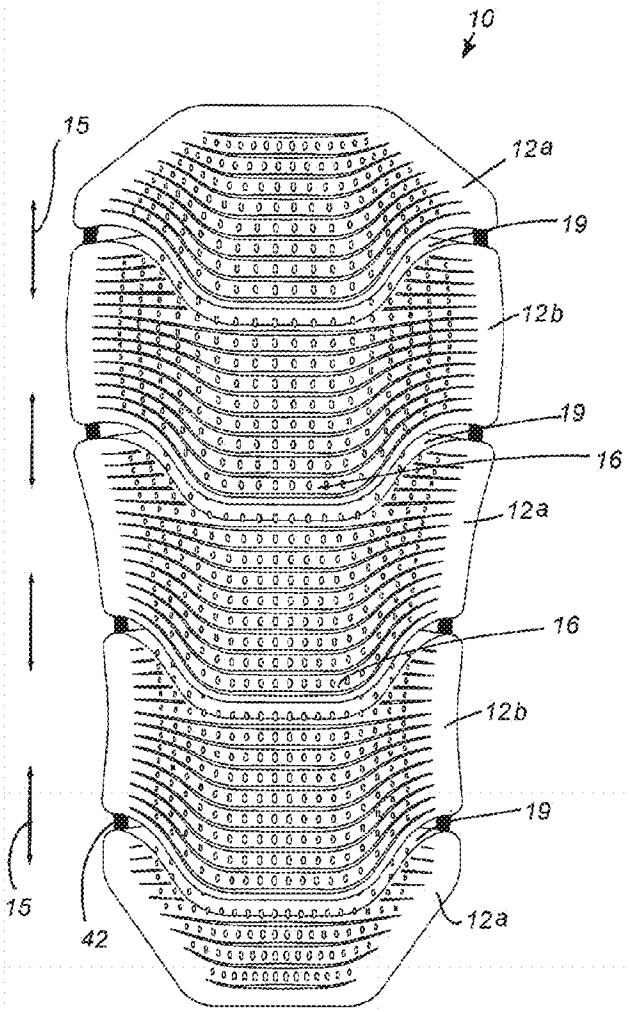
FIGS. 3 and 4 show, respectively, a rear view and front view of a wearable protection device according to an embodiment of the present disclosure in an operating condition.
Figure 3:
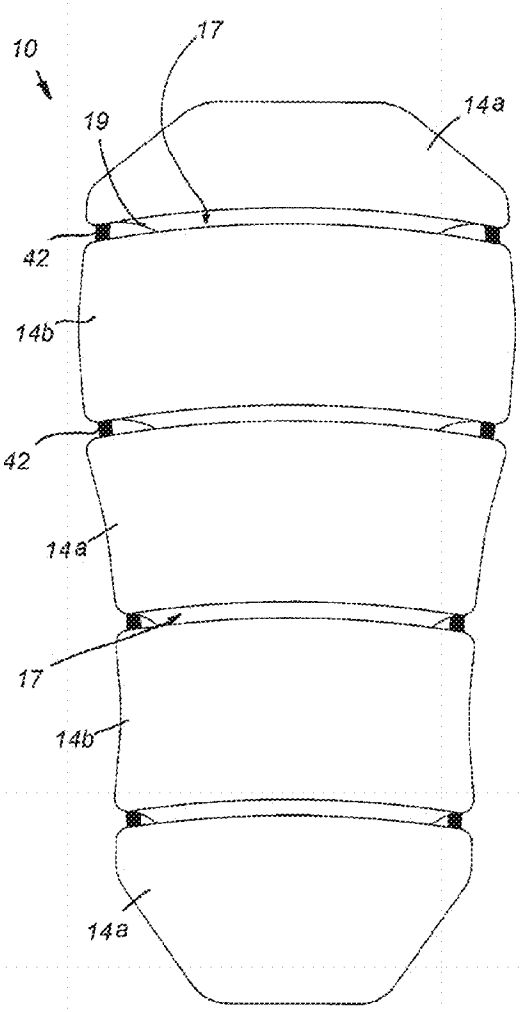

With reference to the accompanying figures, the reference number 10, 110 denotes a wearable protection device according to embodiments of the present disclosure. The wearable protection device 10, 110 is intended to protect against impacts the body of a user, for example a motorcyclist, a skier, a cyclist or more generally a person who is practising a dynamic sport or is performing a working activity which involves a risk of the body suffering knocks or impacts.

In the embodiment shown, the wearable protection device 10, 110 is a back shield or spine protector, i.e. is suitable for arrangement along the user's back, and in particular along the spinal cord or a portion thereof, so as to protect it against impacts or knocks which may damage it.

The back shield 10, 110 may be fastened to the user's body for example by means of shoulder straps and/or stomach belts, not shown, in a manner known to the person skilled in the art. Alternatively, the back shield 110, shown by way of example in FIGS. 9 to 12, is incorporated in a garment 120 or is associated with a garment, for example a motorcyclist's jacket or suit, as will be described below.

In both embodiments, the back shield 10, 110 includes a plurality of adjacent plate members 12*a*, 12*b* which define a protection front surface 13. The protection front surface 13 is adapted to face an impact, namely conventionally is directed outwardly with respect to a user.

Figure 6:
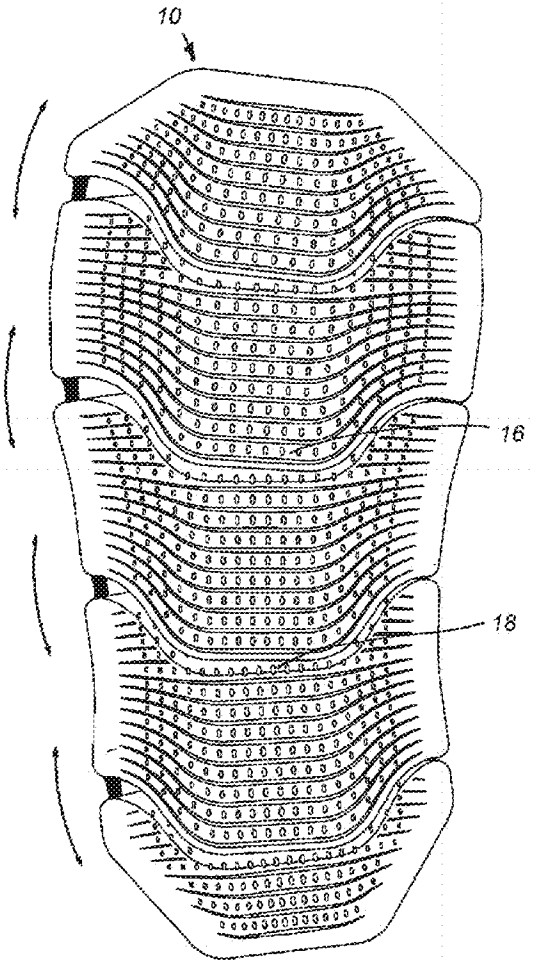
FIGS. 5 and 6 show, respectively, a rear view and front view of a wearable protection device according to an embodiment of the present disclosure in an operating condition.
Figure 5:
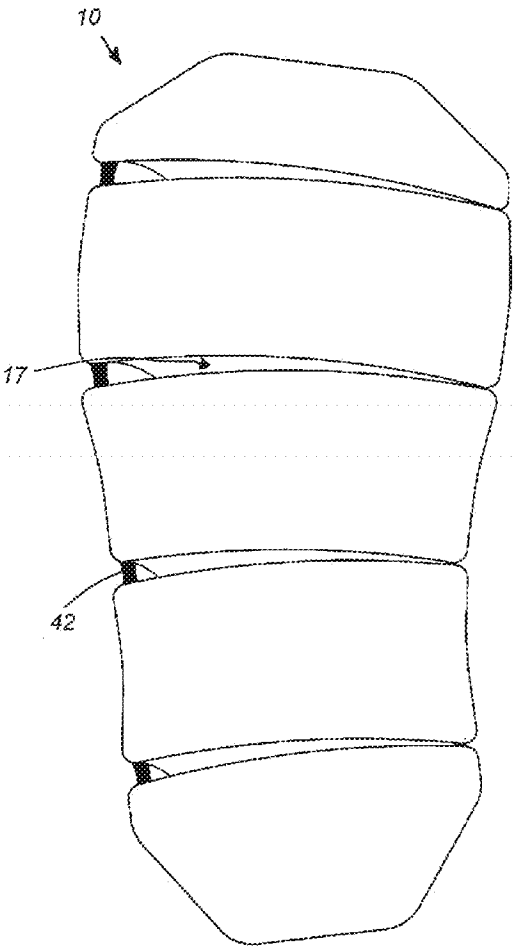
Figure 7:
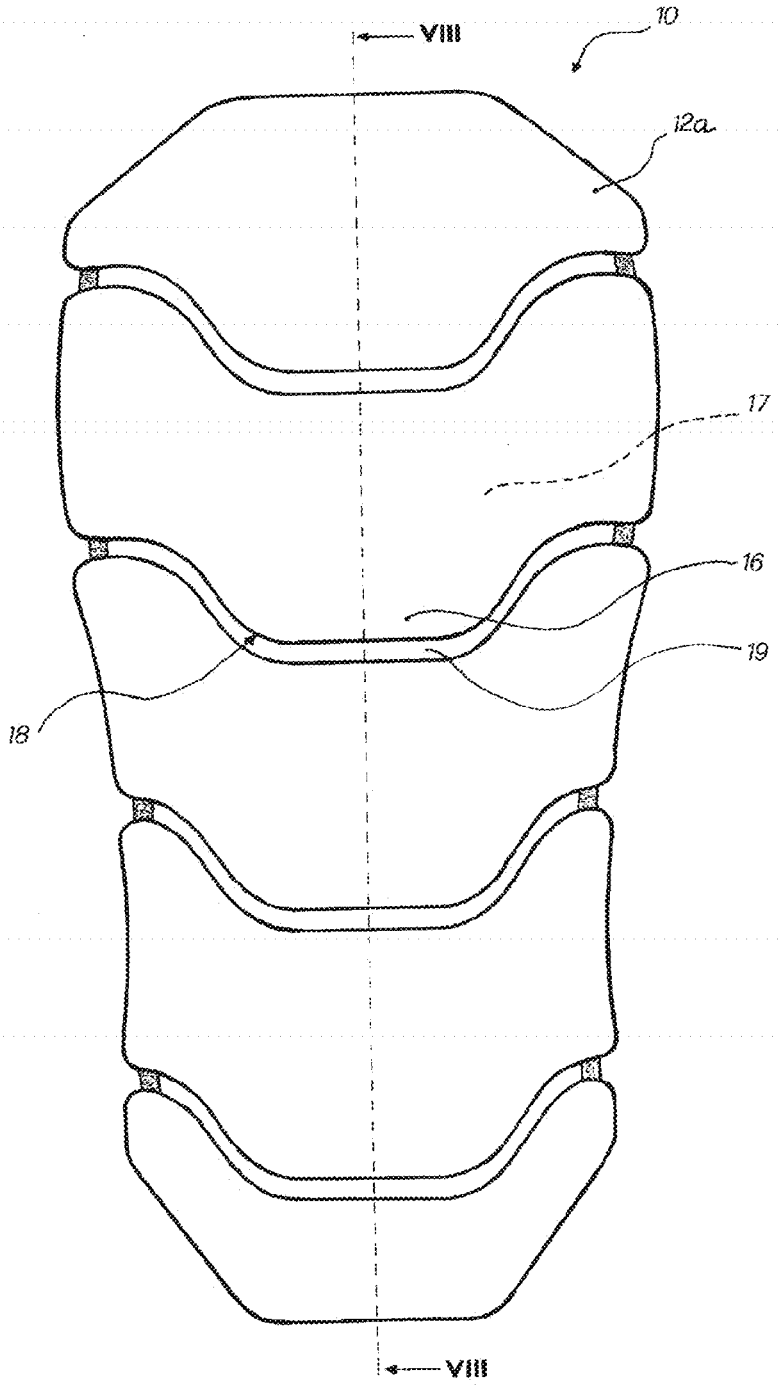
FIG. 7 shows a front view of a wearable protection device according to an embodiment of the present disclosure.

The plate members 12, 12*b* are bound together by means of respective connecting pins 40, only one of which is shown by way of example in FIG. 1, said pins allowing the plate members 12*a*, 12*b* to rotate laterally relative to each other, as can be seen in FIGS. 5 and 6.

The plate members 12*a*, 12*b* are connected together along the respective sides by means of elastic elements 42 which allow the plate members 12*a*, 12*b* to move away from each other in a longitudinal direction 15 and also to return into their original position at the end of a body movement.

Even more particularly, the plate members 12*a*, 12*b* are arranged in pairs partially overlapping each other in the longitudinal direction 15 on the side where said protection front surface 13 is situated. In particular, a first plate member 12*a* of said plate members 12*a*, 12*b* includes a portion 16 which overlaps the front surface 13 of a corresponding portion 19 of a second plate member 12*b* adjacent thereto. In other words, it can be seen that the portion 16 of the first plate member 12*a* is superposed on the corresponding portion 19 on the outside, namely on the side where said protection front surface 13 is situated. Expressed in yet other words, the overlapping zone is arranged on the side where said protection front surface 13 is situated and therefore consists of an overlapping arrangement on the outer side of the wearable protection device 10, 110.

In the example shown, the portion 16 is fin-shaped or lobe-shaped and, when viewed from the side where said front surface 13 is situated, has a smaller width compared to the second plate member 12*b* which it overlaps.

A discontinuity or boundary zone 18 is therefore defined between a fin-like portion 16 of the first plate member 12*a* and the adjacent plate member 12*b*, wherein said discontinuity zone 18 is located on the protection front surface 13 of the second plate member 12*b*. In other words, as a result of overlapping on the outer side between the adjacent plate members 12*a*, 12*b*, the discontinuity between the adjacent plate members 12*a*, 12*b* is located on top of the second plate member 12*b*, namely on the aforementioned corresponding portion 19 of the second plate member 12*b*. The term "discontinuity zone" 18 is understood as meaning an empty space or physical separation in the boundary zone between the fin-like portion 16 of the first plate member 12*a* and the second plate member 12*b*.

Figure 8:
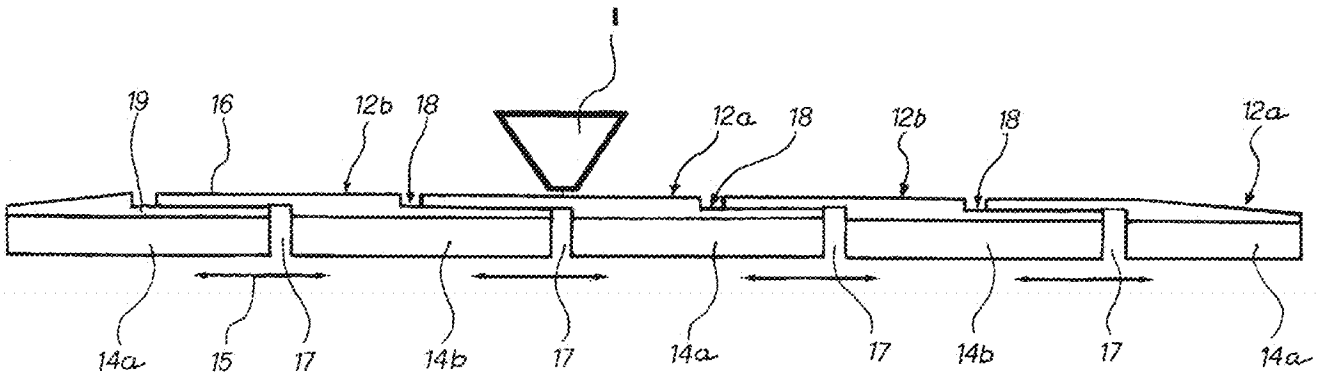
FIG. 8 shows a cross-sectional view along the line VIII-VIII of FIG. 7.
Figure 9:
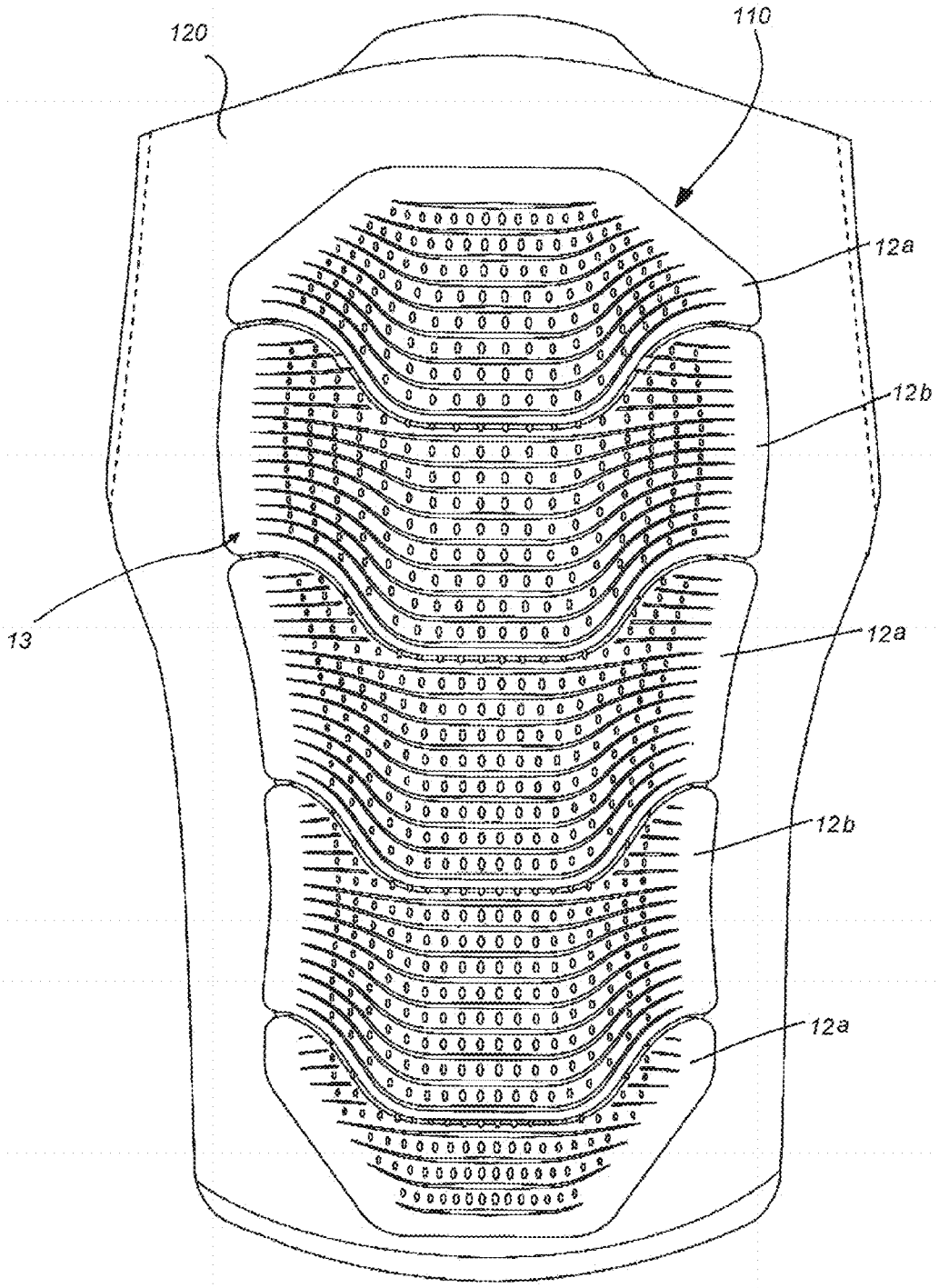
FIG. 9 shows a rear view of a garment including a wearable protection device according to an embodiment of the present disclosure.
Figure 10:
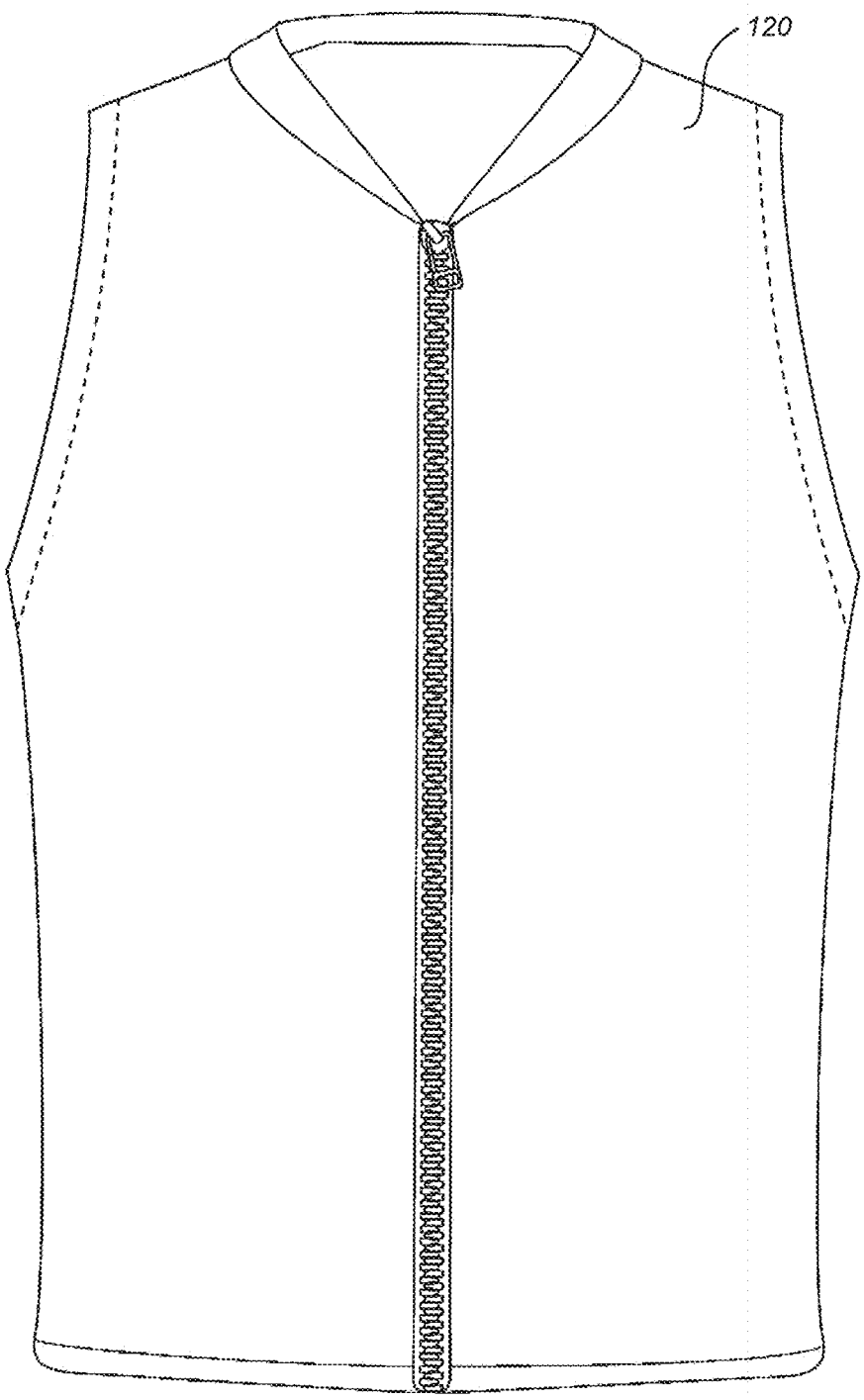
FIG. 10 shows a front view of a garment including a wearable protection device according to an embodiment of the present disclosure.
Figure 11:
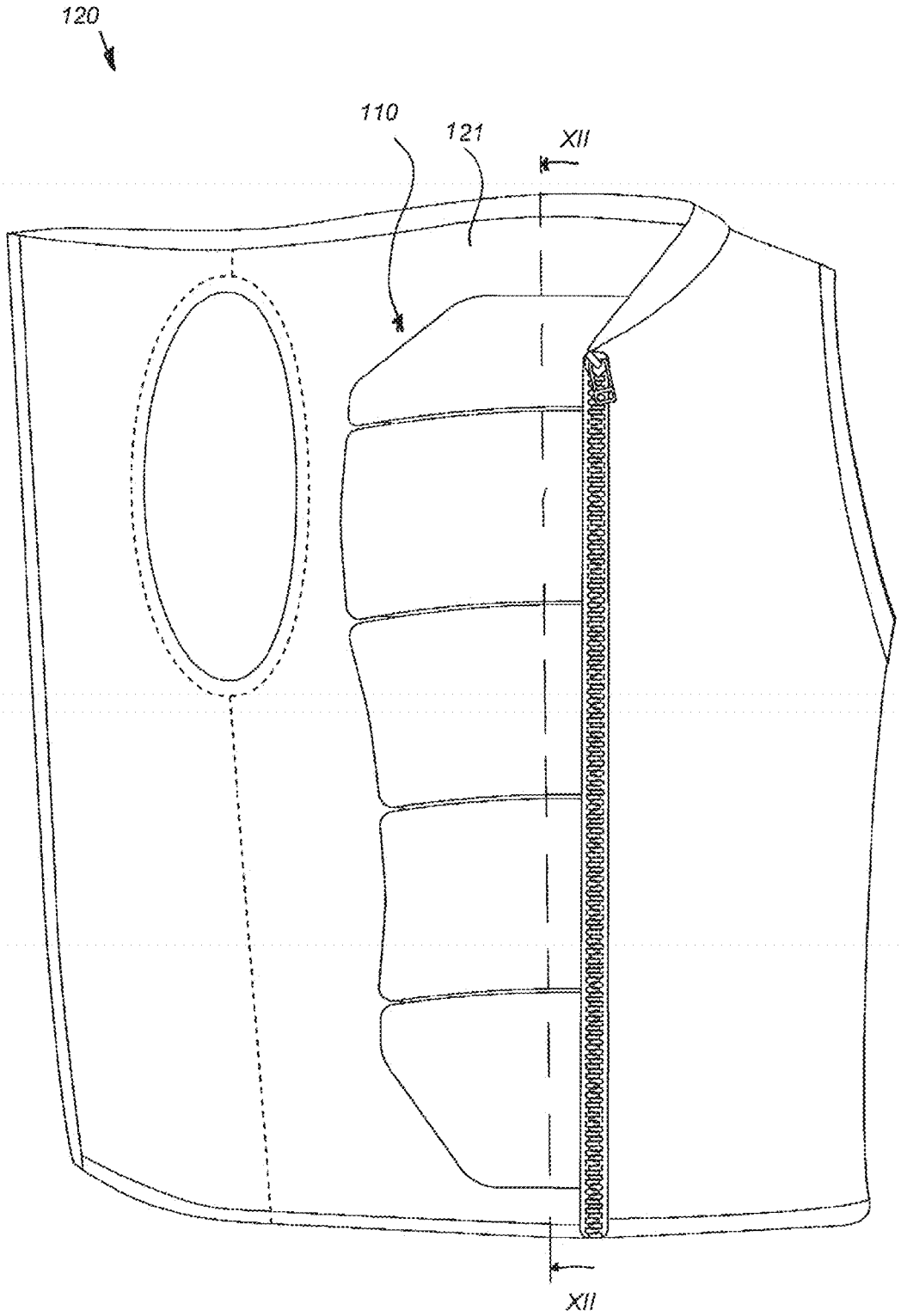
FIG. 11 shows a front view of a garment including a wearable protection device according to an embodiment of the present disclosure in an operating condition.
Figure 12:
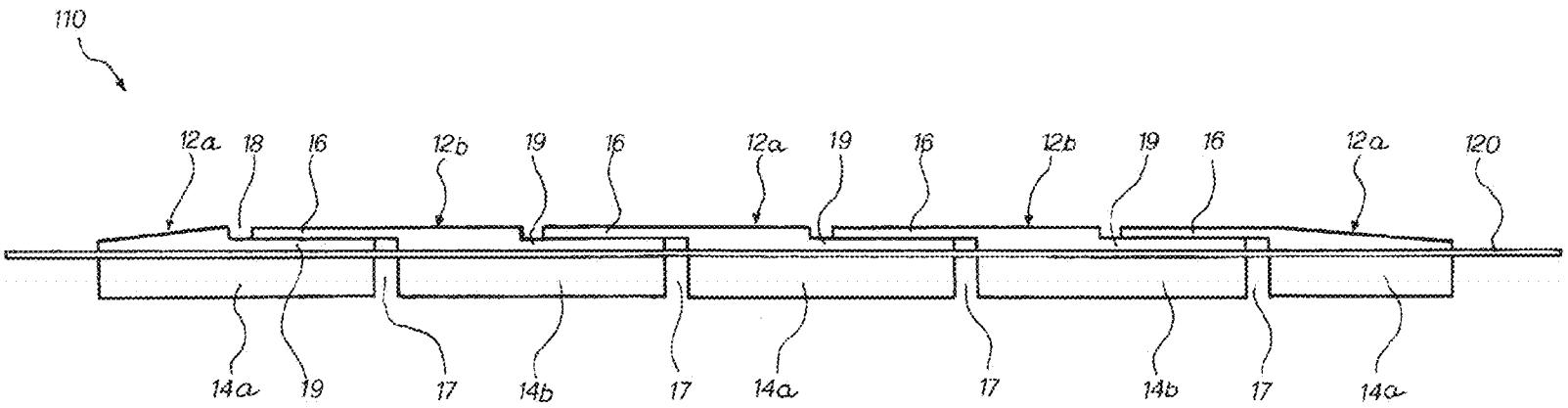
FIG. 12 shows a cross-sectional view along the line XII-XII of FIG. 11.

In the example of embodiment shown, as can be seen in FIGS. 8 and 12, the fin portion 16 of the first member 12*a* has a lower height than a remaining part of the respective first plate member 12*b* and is therefore suitable for being superposed on a corresponding portion 19 of said second plate member 12*b* which has a lower height than a remaining part of said second plate member 12*b*. Said corresponding portion 19 defines a seat for receiving the fin-like portion 16 of the first plate member 12*a*.

It should be noted, moreover, that, owing to the lower height of the fin-like portion 16 and the corresponding portion 19, all the plate members 12*a*, 12*b* are arranged flush with each other on the same level and the protection front surface 13 lies substantially in the same plane.

The back shield 10, 110 also includes a plurality of pads 14*a*, 14*b* which are associated with the plate members 12*a*, 12*b* on the opposite side to said protection front surface 13, namely conventionally on the inner side of the back shield, namely on the inner side facing the user. Each of said plate members 12*a*, 12*b* overlaps at least partially a corresponding pad 14*a*, 14*b* of said plurality of pads. For example, the pads 14*a*, 14*b* are glued or generally fixed to the respective plate members 12*a*, 12*b*.

Essentially, one pad 14*a*, 14*b* is envisaged for each plate member, so that the number of pads 14*a*, 14*b* is at least equal to the number of plate members 12*a*, 12*b*. It can be seen that each pad 14*a*, 14*b* is structurally separate from an adjacent pad, so that each of the pads 14*a*, 14*b* of said plurality of pads 14*a*, 14*b* defines a surface discontinuity 17 with an adjacent pad. The term "surface discontinuity" 17 is understood as meaning an empty space or physical separation in the boundary zone between a pad 14*a* and the adjacent pad 14*b*.

According to a further aspect of the present disclosure, in order to ensure effective protection on the part of the wearable protection device, without the presence of a discontinuity zone 18 between adjacent plate members 12*a*, 12*b* and a surface discontinuity 17 between adjacent pads 14*a*, 14*b* reducing the protection offered by the device 10, 110, said surface discontinuity 14 between adjacent pads 14*a*, 14*b* is offset along said longitudinal direction 15 with respect to the surface discontinuity zone 18 between said fin-like portion 16 of the first plate member 12*a* and the corresponding portion 19 of the second adjacent plate member 12*b*. This offset arrangement is visible in FIGS. 8 and 12.

Essentially, it can be seen that, by means of this offset arrangement along the longitudinal direction 15, a surface discontinuity zone 17 between adjacent pads 14*a*, 14*b* is covered and protected by the fin-like portion 16 of a plate member 12*a*. In fact the fin-like portion 16 extends in the manner of bridge over the surface discontinuity zone 17 between adjacent pads 14*a*, 14*b*.

Furthermore, a discontinuity zone 18 between adjacent plate members 12*a*, 12*b* is covered and protected by the portion 19 of the second plate member 12*b* and by the underlying pad 14*b*.

In other words, the surface discontinuity 17 between adjacent pads 14*a*, 14*b* is covered by the fin-like portion 16 of a plate member 12*a*, and the discontinuity zone 18 between adjacent plate members 12*a*, 12*b* is covered and protected by the second plate member 12*b* and by the underlying pad 14*b*.

The arrangement of the plate members 12*a*, 12*b* and the respective pads 14*a*, 14*b* described above ensures, on the one hand, a high degree of mobility since, as can be seen in the accompanying FIGS. 3-4 and 5-6, both the plate members 12*a*, 12*b* and the pads 14*a*, 14*b* may be moved away from or towards each other, adapting to the movements of a user's body.

At the same time, effective protection is ensured, also when the plate members 12*a*, 12*b* and the pads 14*a*, 14*b* are separated from each other. In fact, owing to the offset arrangement of the surface discontinuity 17 between pads 14*a*, 14*b* and the discontinuity zone 18 between the plate members 12*a*, 12*b*, should an impact occur in a zone corresponding to the discontinuity zone 17 between the pads 14*a*, 14*b*, protection would in any case be ensured by the fact that in these zones there is a fin-like portion 16 (as shown in FIG. 8) which may distribute the impact force both on the first plate member 12*a* and, owing to the overlapping zone, on the second plate member 12*b*. This distributing action is furthermore favoured by the fin profile of the fin-like portion 16 itself, since the impact may be distributed on the second plate member 12*b* along the (right-hand and left-hand) sides of the fin-like portion 16. In fact the second plate member 12*b* in actual fact surrounds the fin-like portion 16.

Moreover, should an impact occur in a zone corresponding to a discontinuity zone between the plate members 12*a*, 12*b*, for example in a boundary zone of the overlapping zone, protection would in any case be guaranteed by the fact that in this zone there is an underlying pad and the portion 19 of the second plate member 12*b* is also present.

In the embodiment shown, each of the plate members 12*a*, 12*b* includes a plurality of ribs 30 which extend over said protection front surface 13. The ribs have a reinforcing function. In the embodiment shown, the ribs 30 have a pattern which follows a profile of said fin-like portion 16 of the first plate member 12*a*, namely a U-shape or wave portion shape. This pattern allows the distribution of the impact forces to be guided along the respective plate member 12*a*, 12*b*.

In fact, should an impact occur along a boundary zone of the fin-like portion 16, owing to the fact that the ribs follow the profile of the fin-like portion 16, it is possible to obtain a distribution of the impact along the entire surface of the corresponding first plate member 12*a*.

With reference to FIGS. 7 to 10, these show a garment 120 which incorporates the aforementioned wearable protection device 110. The garment 120 includes a clothing item taking the form, in the example of embodiment, of a waistcoat which acts as a support for the plurality of plate members 12*a*, 12*b* and for the plurality of pads 14*a*, 14*b*.

In particular, the plate members 12*a*, 12*b* are fixed (for example glued) on an outer side of the clothing item, while the pads are fixed (for example glued) on an inner side. The clothing item may be made of elastic material, so as to act as a resilient element connecting together the adjacent plate members on one side and the pads on the other side. In this embodiment, owing to the presence of the clothing item made of elastic material, the presence of the elastic elements 42 may be dispensed with. In this embodiment also, in order to favour the lateral rotational movement, pins 40 are provided.

The subject of the present disclosure has been described hitherto with reference to preferred embodiments thereof. It is understood that other embodiments relating to the same inventive idea may exist, all of these falling within the scope of protection of the claims which are provided hereinbelow.

The invention claimed is:

1. A wearable protection device comprising a plurality of plate members adjacent in a side-by-side configuration so as to define a protection front surface, or side, adapted to face an impact, wherein pairs of said plate members at least partially overlap each other along a longitudinal direction by means of superposition of a portion of a first plate member of said plate members on a front surface of a corresponding portion of a second plate member adjacent in the side-by-side configuration, so as to define a zone of surface discontinuity between adjacent plate members on the front surface of said second plate member, said device comprising a plurality of pads each of said pads being associated with one of said plate members on an opposite side with respect to said protection front surface, and wherein a first pad associated with the first plate member is structurally separate from a second pad associated with the second plate member so as to define a surface discontinuity or boundary zone between adjacent first pad associated with the first plate member and second pad associated with the second plate member, wherein said surface discontinuity or boundary zone between adjacent first and second pads is offset along said longitudinal direction with respect to the zone of surface discontinuity between adjacent plate members.

2. The wearable protection device according to claim 1, wherein said portion of a first plate member overlaps in the manner of a bridge said surface discontinuity between adjacent pads.

3. The wearable protection device according to claim 2, wherein said portion of the first plate member has a lower height than a remaining part of the respective first plate member and said corresponding portion of said second plate member has a lower height than a remaining part of said second plate member and defines a seat for receiving said portion of the first plate member.

4. The wearable protection device according to claim 1, wherein said portion of the first plate member is fin-shaped or lobe-shaped.

5. The wearable protection device according to claim 4, wherein said portion of a first plate member overlaps in the manner of a bridge said surface discontinuity between adjacent pads;

said portion of the first plate member has a lower height than a remaining part of the respective first plate member and said corresponding portion of said second plate member has a lower height than a remaining part of said second plate member and defines a seat for receiving said portion of the first plate member; and said portion of the first plate member, when viewed from said protection front surface, has a smaller width compared to the second plate member such that said second plate member laterally surrounds said portion of the first plate member.

6. The wearable protection device according to claim 1, comprising a plurality of ribs associated with each of said plate members on said protection front surface.

7. The wearable protection device according to claim 1, wherein said ribs extend with a pattern which follows a profile, or free edge, of said portion of said first plate member.

8. The wearable protection device according to claim 1, wherein each rib is U-shaped or shaped as a wave portion.

9. The wearable protection device according to claim 1, wherein pairs of said plate members are bound together by means of a pin element.

10. The wearable protection device according to claim 1, comprising elastic connecting elements which connect said plate members.

11. The wearable protection device according to claim 10, wherein said elastic connecting elements are elements individually distinct from one another, each elastic connecting element being located between adjacent plate members.

12. The wearable protection device according to claim 1, wherein said wearable device is a spine protector adapted to protect at least a portion of the spine of a user.

13. A garment comprising at least one wearable protection device according to claim 1.

14. The garment according to claim 13, said garment including a clothing item, and wherein said wearable protection device is included in a fixed way in said clothing item.

15. The garment according to claim 14, wherein said plate members are arranged on an outer side of said clothing item and said pads are arranged on an inner side of said clothing item.

16. The garment according to claim 15, wherein said clothing item is made of elastic material and acts as a resilient element for connecting adjacent plate members.

17. The wearable protection device according to claim 1, wherein both the plate members and the pads may move away from and towards the adjacent plate members and the adjacent pads respectively.

18. The wearable protection device according to claim 1, wherein said pairs of said plate members further define an overlap zone between adjacent plate members and each of said pads extends over at least a portion of said one of said plate members including said overlap zone.

19. A wearable protection device comprising a plurality of plate members adjacent in a side-by-side configuration so as to define a protection front surface, or side, adapted to face an impact, wherein pairs of said plate members at least partially overlap each other along a longitudinal direction by means of superposition of a portion of a first plate member of said plate members on a front surface of a corresponding portion of a second plate member adjacent in the side-by-side configuration, so as to define a zone of surface discontinuity between the first plate member and the second plate member on the front surface of said second plate member, said device comprising a plurality of pads, each of said pads being associated with one of said plate members on an opposite side with respect to said protection front surface, wherein a first pad associated with the first plate member is structurally separate from a second pad associated with the second plate member so as to define a surface discontinuity or boundary zone between adjacent first pad associated with the first plate member and second pad associated with the second plate member, one of the first pad and second pad extending over the zone of surface discontinuity between the first plate member and the second plate member, and wherein said surface discontinuity or boundary zone between adjacent first and second pads is offset along said longitudinal direction with respect to the zone of surface discontinuity between the first plate member and the second plate member, one of said first member and second plate member extending over the surface discontinuity or boundary zone between the first pad and second pad.

* * * * *